United States Patent [19]

Bradley

[11] Patent Number: 4,560,503

[45] Date of Patent: Dec. 24, 1985

[54] FLUID WASTE DISPOSAL

[75] Inventor: John S. Bradley, Tulsa, Okla.

[73] Assignee: John D. Gassett, Tulsa, Okla. ; a part interest

[21] Appl. No.: 412,887

[22] Filed: Aug. 30, 1982

[51] Int. Cl.[4] ..... G21F 9/24

[52] U.S. Cl. ..... 252/633; 405/128

[58] Field of Search ..... 252/633; 405/128

[56] References Cited

U.S. PATENT DOCUMENTS

| | | | |
|---|---|---|---|
| 3,108,439 | 10/1963 | Reynolds et al. | 252/633 |
| 3,274,784 | 9/1966 | Shock et al. | 252/633 |
| 4,400,314 | 8/1983 | Ellis et al. | 252/633 |

FOREIGN PATENT DOCUMENTS

| | | | |
|---|---|---|---|
| 1054740 | 1/1967 | United Kingdom | 252/633 |

OTHER PUBLICATIONS

Dickey et al., "Oil and Gas Reservoirs with Subnormal Pressures" *Amer. Assoc. Pet. Geol. Bull.* 61(12), Dec. 1977, pp. 2134–2142.

Mason, "Hugoton Panhandle Field, Kansas, Oklahoma, Texas" in Beebe et al., Eds. *Natural Gases of North America,* Amer. Assoc. Pet. Geol. Tulsa, Okla., 1968, pp. 1539–1547.

Holland, "Salt Water Disposal Wells . . . "Presented at Heart of Amer. Drilling & Production Inst., Feb. 8–9, 1972, Garden City, Kansas.

*Primary Examiner*—Deborah L. Kyle

[57] ABSTRACT

A method of disposing of fluid waste in underground permeable strata having original fluid pressure in the pores which is less than normal hydrostatic pressure.

4 Claims, 1 Drawing Figure

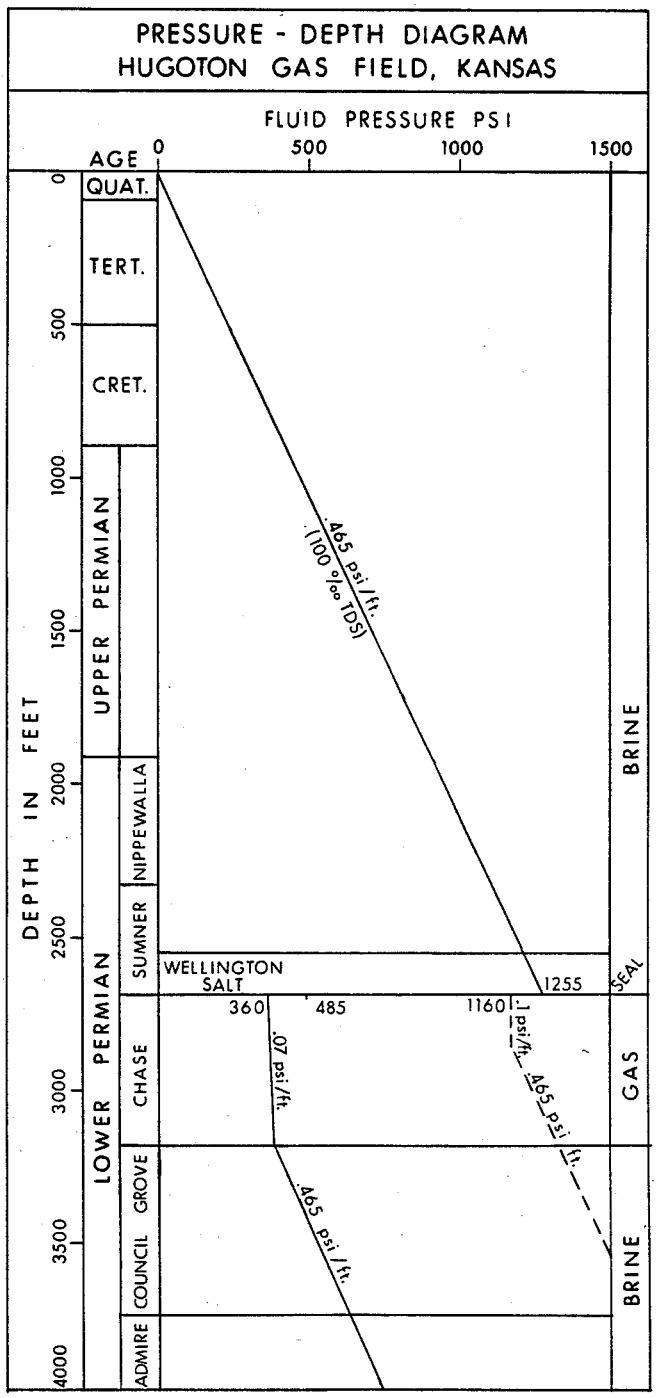
PRESSURE - DEPTH DIAGRAM
HUGOTON GAS FIELD, KANSAS
FLUID PRESSURE PSI
0
500
1000
1500
AGE
QUAT.
TERT.
CRET.
UPPER PERMIAN
LOWER PERMIAN
NIPPEWALLA
SUMNER
CHASE
COUNCIL GROVE
ADMIRE
DEPTH IN FEET
0
500
1000
1500
2000
2500
3000
3500
4000
.465 psi/ft.
(100 ‰ TDS)
WELLINGTON SALT
1255
360
485
1160
.07 psi/ft.
.1 psi/ft.
.465 psi/ft.
.465 psi/ft.
BRINE
SEAL
GAS
BRINE

FLUID WASTE DISPOSAL

PRIOR DISCLOSURES

Perhaps the closest prior disclosures to this invention is the art of disposing of salt water brines in oil field operations. Typical of this disclosure is an article entitled "Salt Water Disposal Wells, Zones of Interest, and Production Company Viewpoints in the TriState Area of Texas, Oklahoma and Kansas" by D. W. Holland, Cities Service Oil Company, Guymon, Okla., presented at the Heart of America Drilling and Production Institute Feb. 8 and 9, 1972, Garden City, Kans. The section on "Zones of Future Interest" on pages 5 and 6 lists possible zones for disposal, depth and disposal rates.

Subnormal-pressure fields are discussed in an article, "Oil and Gas in Reservoirs with Subnormal Pressures", by Dickey and Cox, the American Association of Petroleum Geologists Bulletin, V. 61, No. 12 (December, 1977) pp. 2134–2142.

BACKGROUND OF THE INVENTION

1. Field of the Invention

This invention relates primarily to the disposal of fluid waste. It relates especially to the underground disposal of toxic liquid waste.

2. Setting

An unwanted by-product of our industrial society is toxic liquid waste. This toxic liquid waste must be disposed by some safe means. However, in most cases there appears to be no such disposal means readily available. In some cases it has been placed in tar-sealed barrels and buried in shallow graves, or dumped to the ocean floor or pumped into shallow wells. This appears satisfactory until the barrels start to leak or until displaced fluids or waste itself is pumped into aquifers or to the surface.

BRIEF DESCRIPTION OF THE INVENTION

This concerns a system and method for the disposal of fluid waste and especially toxic or radio-active liquid waste. I first locate convenient, porous, permeable, sub-surface strata which, before any fluid has been removed therefrom has fluid pressure in the pores which is less than the normal hydrostatic pressure of the water for that depth of strata in that area. This may be called a sealed underpressured reservoir. Industrial fluid waste is then flowed by gravity into such strata at a rate so that the fluid pressure never exceeds the normal hydrostatic pressure.

I know of no prior art which teaches to search for and find a sealed, sub-surface reservoir by detecting an abnormally low fluid pressure, then drilling a disposal well into it, and disposing of fluid in a manner and rate so as not to disturb the seal.

DESCRIPTION OF THE DRAWINGS

Various objects and a better understanding of the invention can be had from the following description taken in conjunction with the drawing which is a Pressure-Depth Diagram of the Hugoton Gas Field in Kansas.

DETAILED DESCRIPTION

The problem of liquid-waste disposal, particularly that of toxic or radioactive wastes, has become a major technical and political problem of our society. If the technical problem of safe waste-disposal through time can be solved, the political problem might be much alleviated.

Liquid wastes may be safely disposed of by utilizing underpressured reservoirs, a natural phenomenon, as a repository for the wastes. By the very fact of being underpressured; i.e., below the normal hydrostatic pressure for its depth, the reservoir indicates that it is, and has been, sealed off from the surface and from surrounding normally pressured reservoirs. The fact that the pore fluid pressure is below normal hydrostatic pressure for its depth is prima facie evidence that such strata are sealed. The age of the seal cannot always be determined, but where it can be, the ages are on the geological time scale, hundreds of thousands to millions of years, and thus may be considered a "permanent" seal in our usual time frame, and fluid can neither enter or escape.

In accordance with my invention, I drill a well into such underpressured reservoir and line it with proper casing and cement. I then dispose of the liquid waste into the reservoir under conditions so that the effective fluid pressure in the reservoir never exceeds the normal hydrostatic pressure. This way the natural seal is never disturbed or broken.

In accordance with my invention this permanently-sealed, underpressured reservoir can be filled with liquid waste until the reservoir approaches normal pressure without disturbing the seal or displacing any fluids outside the seal. By "normal pressure" I mean that pressure equal to the pressure exerted by the formation fluids from the surface to the specific depth within the underpressured reservoir. It is found by multiplying the depth by the pressure gradient (psi/ft) of the formation water column. This can be obtained by obtaining samples of the water from the strata and determining its density. A "normal" hydrostatic gradient is assumed to be 0.465 psi/ft which corresponds to a 100 parts per thousand total dissolved solid (TDS) brine or a density of 1.075 gm/cm$^3$. While this is a good average value, the pressure calculated for a shallow hole may be up to 50 psi too high, and for a deep hole with heavier brines may be as much as 150 psi too low. Thus, one should make an accurate determination from the measured density of the sample fluid of the strata into which fluid is to be disposed. To be safer, the abnormally-low pressure zone should be beneath an upper zone which has fluid in its pores at a normal hydrostatic pressure. This will avoid some near-surface (e.g., a few hundred feet) effects like perched water tables which could give low pressure without proving a pressure seal.

The conventional disposal through an injection well into a normally pressured reservoir displaces freely-migrating reservoir fluids, eventually to the surface, which can pollute the natural fluids and perhaps enter the food chain. However, even if, in using my invention, the seal of an underpressured reservoir were breached, as by improperly cemented or abandoned wellbores or by tectonic events, the normally pressured fluids from surrounding reservoirs would merely flow into the breach until pressures became normal. There would be no tendency to force the liquid waste to escape from the reservoir.

Underpressured reservoirs are known throughout the world and are widespread in North America. An example of the underpressured field would be the Hugoton Gas Field, chosen here because of the ready availability of data from an article by John W. Mason, "Hugoton Panhandle Field, Kansas, Oklahoma and Texas," published in 1968 by the American Association of Petroleum Geologists in "*Natural Gases of North America, Volume Two*". The field contains five and a half million acres. Wells are patterned on a mile grid; i.e., 640 acre spacing. The Permian Wolfcampian Chase Group, limestones, dolomites, and shales, are gas productive.

In the Kansas portion of the field the following averages apply:

| | |
|---|---|
| permeability | 5 md |
| porosity | 14% |
| water saturation | 25% |
| productive thickness | 45 feet |

The initial reservoir pressure was 485 psia and the 1965 reservoir pressure 360 psia. The present pressure is even less. The average formation temperature is 90° F. and the average depth to the formation is 2700 feet. The shale, anhydrite, and salt of the Wellington formation provide the upper seal and reduced permeability and the bottom water provide the lateral and bottom seals.

If we assume the averages above for the Chase Group and assume the water table at the base of the Chase, the pressure regime can be represented as in FIG. 1 of the drawing. If liquid wastes were injected into the reservoir to raise the pressure from 360 psi to 1160 psi, still well below the "normal" hydrostatic pressure of 1255 psi, the amount of liquid waste injected per well can be calculated as follows:

$$D = h\,A\,\phi\left\{S_w C_L (P_2 - P_1)[1 + E_v(T_1 - T_2)] + S_G\left[1 - \left(\frac{P_1}{P_2}\right)\left(\frac{Z_2}{Z_1}\right)\left(\frac{T_2}{T_1}\right)\right]\right\}$$

where:

D is disposal volume, $ft^3$ h is reservoir thickness, ft

A is reservoir area, $ft^2$ $\phi$ is porosity (decimal)

$C_L$ is liquid compressibility, $\frac{ft^3/ft^3}{psi}$ $S_w$ is water saturation (decimal)

$S_G$ is gas saturation (decimal)

$E_v$ is volume coefficient of expansion $\frac{ft^3/ft^3}{°F.}$

P is pressure, psi z is $CH_4$ gas correction

T is temperature °R

For the Hugoton reservoir:

h=45 ft (effective, out of 500 ft total)

A=640 acres×43,560 $ft^2$/acre=27.9×$10^6$ $ft^2$ $$\phi = .14\left(\frac{\text{volume pores}}{\text{volume total}}\right)$$

volume of reservoir is h A=1255.5×$10^6$ $ft^3$ volume of pores is h A $\phi$=175.77×$10^6$ $ft^3$ And $S_w$=0.25

$S_G$=0.75

And volume of brine is h A $\phi$ $S_w$=43.94×$10^6$ $ft^3$ volume of gas is h A $\phi$ $S_G$=131.83×$10^6$ $ft^3$ And $P_1$=360 psi $P_2$=1160 psi $P_2-P_1$=800 psi $T_2=T_1$=90° F.=500° R $$C_L = 3 \times 10^{-6}\,\frac{ft^3/ft^3}{psi}$$

$$E_v = 400 \times 10^{-6}\,\frac{ft^3/ft^3}{°R.}$$

$Z_1$=0.96

$Z_2$=0.90

$T_2/T_1$=1

$P_1/P_2$=0.31

$Z_2/Z_1$=0.94

460° R=0° F.

Thus, for these sample assumptions, $$D = 45 \cdot 27.9 \cdot 10^6 \cdot .14\left\{.25 \cdot 3 \cdot 10^{-6} \cdot 800[1 + 400 \cdot 10^{-6} \cdot 0] + .75\left[1 - \left(\frac{360}{1160}\right)\left(\frac{.90}{.96}\right)\left(\frac{550}{550}\right)\right]\right\}$$

D=93.58×$10^6$ $ft^3$/well or

D=16.67×$10^6$ bbl/well

If the reservoir well were all liquid ($S_w$=1),

D=75,139 bbl/well

If the reservoir well were all gas ($S_G$=1),

D=22.2×$10^6$ bbl/well

This difference is due to the difference in compressibility of the brine and the methane. To inject large volumes of liquid into a liquid-filled reservoir would require a thicker, more porous reservoir; i.e., a higher pore volume per well, than this example calculates.

While the invention has been described with a certain degree of particularity, it is manifest that many changes may be made in the details without departing from the spirit and scope of this disclosure. It is understood that the invention is not limited to the exemplified embodiments set forth herein but is to be limited only the scope of the attached claims or claims, including the full range of equivalency to which each element thereof is entitled.

What is claimed:

1. A method of disposing of fluid industrial waste which comprises:

locating a porous, permeable, sub-surface stratum which, before any fluid has been removed therefrom, has fluid pressure in the pores thereof which is less than normal hydrostatic pressure for that depth of said stratum in that area;

flowing industrial fluid into said stratum at a rate so that said fluid pressure never exceeds said normal hydrostatic pressure.

2. A method of disposing of fluid waste which comprises flowing said waste through wells drilling into permeable strata having original fluid pressure in the pores which is less than normal hydrostatic pressure.

3. A method as defined in either claim 1 or 2 in which said strata is beneath an upper zone which has fluid in its pores at a normal hydrostatic pressure.

4. A method as defined in claim 1 or 2 in which the normal hydrostatic pressure is determined by measuring the density of sample fluid from the strata and using such density and strata depth to obtain the normal hydrostatic pressure.

* * * * *